United States Patent [19]

Peterson

[11] Patent Number: 4,570,803

[45] Date of Patent: Feb. 18, 1986

[54] PORTABLE BALCONY ACCESSORY

[76] Inventor: Earl H. Peterson, 2300 W. San Angelo, #2164, Gilbert, Ariz. 85234

[21] Appl. No.: 741,481

[22] Filed: Jun. 5, 1985

[51] Int. Cl.[4] ..... A47F 5/08

[52] U.S. Cl. ..... 211/88; 108/47; 211/90; 248/118; D6/574

[58] Field of Search ..... 211/90, 88, 87; 108/25, 108/47, 135, 152; 312/140.2, 140.4, 245; D6/513, 514, 567, 573, 574; 248/118, 118.5

[56] References Cited

U.S. PATENT DOCUMENTS

| | | | |
|---|---|---|---|
| 1,727,032 | 9/1929 | Guignon | 108/27 |
| 2,558,366 | 6/1951 | Madlena | 108/47 |
| 3,706,105 | 12/1972 | Nicholas et al. | 211/88 X |
| 3,895,605 | 7/1975 | Goldman | 211/88 X |

FOREIGN PATENT DOCUMENTS

| | | | |
|---|---|---|---|
| 817148 | 7/1969 | Canada | 108/25 |

*Primary Examiner*—Robert W. Gibson, Jr.

*Attorney, Agent, or Firm*—James H. Phillips; Charles E. Cates

[57] ABSTRACT

A balcony accessory is disclosed which is adapted to be suspended from a balcony rail or the like to provide comfortable support for a person observing the view from the balcony and also to provide storage for paraphernalia which the user may wish to have at hand. A generally horizontal elongated structure is cantileveredly supported from the balcony rail by a bracket assembly proximate each end. The bracket assemblies have downwardly opening channels adapted to engage the upper portion of balcony rail (or partial wall). An upright back edge, end walls and one edge of an elongated pad define a horizontal tray-like storage area having a horizontal bottom piece serving as the tray-like area floor. The elongated pad extends upwardly and is disposed with its outer edge generally aligned with the outer edge of the horizontal bottom piece. Optionally, a weatherproof cover, held in place by a series of mateable snaps or the like, may be employed to afford a degree of weather protection when the accessory is left in place on a balcony.

6 Claims, 5 Drawing Figures

3
2
13
6
26
5
31
14
2
26
2
12
11
10
4
3
7
9
8
26
6
15

3
2
16
5
6
7
1
22
17
24
32
21
19
34
33
4
23
21
18
24

3
2
3
26
26
26
5
10
26
31
14

3
2
27
27
27
25
30
36

7
27
27
30
25
36
35
29

PORTABLE BALCONY ACCESSORY

FIELD OF THE INVENTION

This invention relates to balcony accessories and, more particularly, to a removable portable arm rest structure adapted for suspension from a balcony rail.

BACKGROUND OF THE INVENTION

A substantial segment of the population dwell in apartments, condominiums or the like which include balconies to provide access to and enjoyment of the outside. Many persons enjoy standing or sitting near the balcony rail to survey the view. Typically, however, the rails themselves are narrow metal structures or somewhat wider masonry structures, neither of which is conducive to bearing the weight of one desiring to lean forward and rest his arms on the rail.

Thus, it will be appreciated that it would be desirable to provide means which may be removably affixed to a balcony rail and which serves to provide comfortable support for an observer leaning toward the rail. It will further be appreciated that it would be desirable to provide such means which includes traylike features for supporting drinks, ashtrays, or such other paraphernalia which the user might wish to have at hand.

OBJECTS OF THE INVENTION

It is therefore a broad object of my invention to provide a balcony accessory for bearing the weight of a person by supporting his arms in a comfortable fashion.

It is another object of my invention to provide such means which are readily detachably supported from the balcony rail.

It is a more specific object of my invention to provide such accessory means which include a traylike compartment for securely supporting paraphernalia which a user may wish to have at hand.

In another aspect, it is another object of my invention to provide such balcony accessory means which includes a securely affixable cover to afford weather protection for the accessory when it is secured to the balcony rail.

SUMMARY OF THE INVENTION

These and other objects of my invention are achieved by providing a generally horizontal elongated structure cantileveredly supported proximate each end by a bracket assembly having a downwardly open channel adapted to engage the upper portion of a balcony rail or partial wall. An upright back edge, end walls and one edge of an elongated pad define a horizontal tray-like storage area having a horizontal bottom piece serving as the tray-like area floor. The elongated pad extends upwardly and is disposed with its outer edge generally aligned with the outer edge of the horizontal bottom piece. Optionally, a weatherproof cover, held in place by a series of mateable snaps or the like, may be employed to afford a degree of weather protection when the accessory is left in place on a balcony.

DESCRIPTION OF THE DRAWING

The subject matter of the invention is particularly pointed out and distinctly claimed in a concluding part of the specification. The invention, however, both as to organization and method of fabrication and operation, may best be understood by reference to the following detailed description taken in conjunction with the subjoined claims and the accompanying drawing of which:

DETAILED DESCRIPTION OF THE INVENTION

Figure 1:
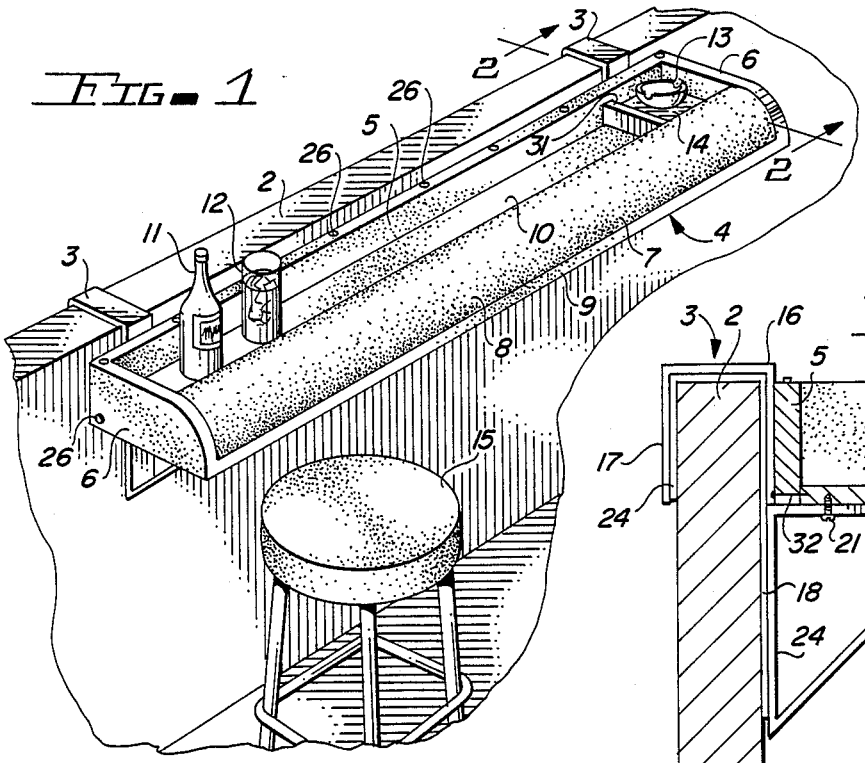
FIG. 1 is a pictorial view of my balcony accessory illustrated operatively emplaced on a balcony rail.

Referring now to FIG. 1, there is presented an exemplary embodiment of my balcony accessory 1 shown operatively suspended from the top of a balcony rail 2 by a pair of brackets 3 each of which is disposed proximate one end of the balcony accessory. The balcony accessory 1 is a generally elongated structure comprising a rectangular horizontally disposed bottom piece 4 having opposed short and opposed long edges. As will be explained below, is firmly anchored to and supported by the brackets 3. An upright inner wall 5 and end walls 6, in conjunction with the bottom piece 4, define a table-like area. An elongated rectangular pad 7, having opposed short and opposed long edges, extends between the end walls 6 and has an outer edge 8 in substantial alignment with the outer edge 9 of the bottom piece 4.

The width of the pad 7 is not critical, but may be on the order of one-half the width of the bottom piece 4. As a result, a horizontal tray-like storage area 10 is defined by the inner edge of the pad 7, the outer face of the inner wall 5, and the inner faces of the end walls 6. It will be apparent that the tray-like storage area 10 can receive and support bottles 11, glasses 12 containing drinks, an ash tray 13 (which is preferably supported on a ledge 14 having a lip 31 in order to raise it to a convenient height and prevent its sliding into the lower tray area), or such other paraphernalia as a user of my accessory may wish to have at hand on the balcony.

It will be apparent that my balcony accessory 1 can be used by a person standing, but comfortably leaning his weight against the pad 7 or, alternatively, seated, as on a stool 15 of appropriate height. Any paraphernalia which the user wishes to have at hand may be placed into the tray-like storage area 10 which affords convenient and safe support.

Figure 2:
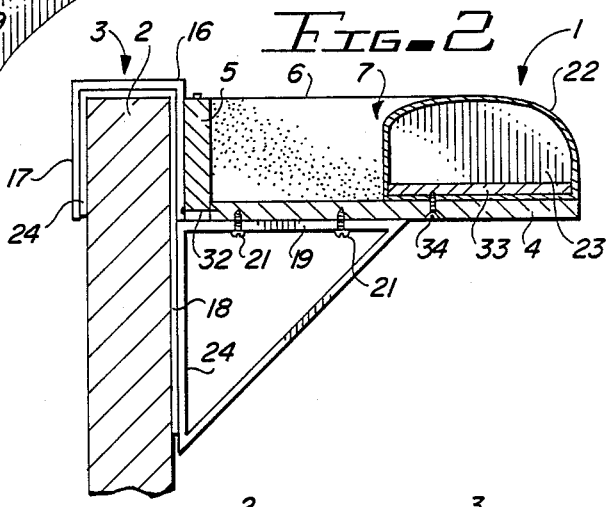
FIG. 2 is a cross-sectional view taken along the lines 2—2 of FIG. 1.
Figure 3:
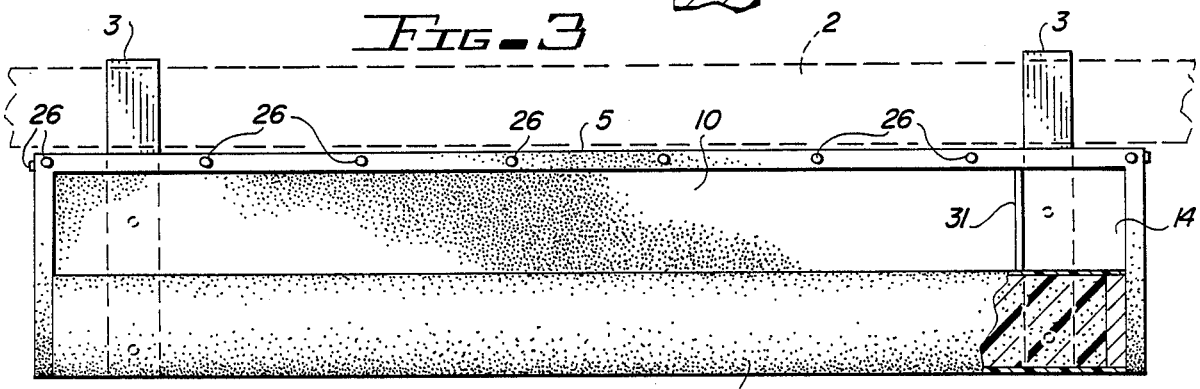
FIG. 3 is a top view of my balcony accessory.

Certain aspects of the structure of an exemplary embodiment of my balcony accessory 1 will become more apparent from an examination of FIG. 2, which is a cross-sectional view, with simultaneous reference to FIGS. 1 and 3. Each bracket 3 is preferably a one-piece sturdy metal structure generally including: (1) a downwardly open U-shaped channel section comprising horizontal top 16, short, outside leg 17 and long, downwardly extending inside leg 18; and (2) a triangular supporting section comprising the lower portion of leg 18, horizontal leg 19 and hypotenuse section 20. As will be apparent from FIG. 2, bottom piece 4 is supported atop horizontal leg 19 of the bracket 3 and is held in place by screws 21 which extend through apertures in horizontal leg 19 and into the bottom of bottom piece 4. Inner wall 5 may be fixed to bottom piece 4 by nails, as at 32, screws or glue.

The pad 7, built up from foundation board 33, preferably has an outer cover 22 of a sturdy material such as vinyl or leather. The interior may be stuffed with any suitable resilient padding such as foam rubber or the like. Each end of the pad preferably terminates in a wooden block 23 which facilitates attaching the outer pad cover 22 and also helps contain the padding material encompassed by the pad cover. The pad 7 may be held in place by any convenient means such as screws 34 extending through apertures in the bottom piece 4 and into the wooden blocks 23 and/or the foundation board 33.

It will be understood that the horizontal top section 16 of each bracket 3 can be of any appropriate length to accommodate the corresponding thickness of a given balcony rail 2. While this dimension could be made adjustable (as by making the horizontal top section of two overlapping pieces which can be secured together when the desired degree of overlap is obtained), I prefer the one-piece structure illustrated as more stable. In order to avoid marring the balcony rail 2, a resilient lining 24 may be attached to the inner surfaces of the bracket legs 17, 18 and the bracket horizontal top 16. This lining may be, by way of example, fitted from conventional indoor/outdoor carpeting material which affords long wearing properties and withstands weather well.

While the bottom piece 4, inner wall 5, and end walls 6 may be fabricated from any reasonably lightweight and strong material, wood is presently preferred since it is readily available in four-foot lengths of 1"×4" cuts. Four feet has been found to be a convenient length for the balcony accessory such that a single commonly commercially available four-foot piece of 1"×12" lumber can be cut lengthwise (at about the eight inch or nine inch position as may be desired) to provide the bottom piece 4 and inner wall 5. The end walls 6, foundation board 33 and pad end pieces 23 may simply be made up from such small pieces (even scrap) of lumber as may be at hand.

Figure 4:
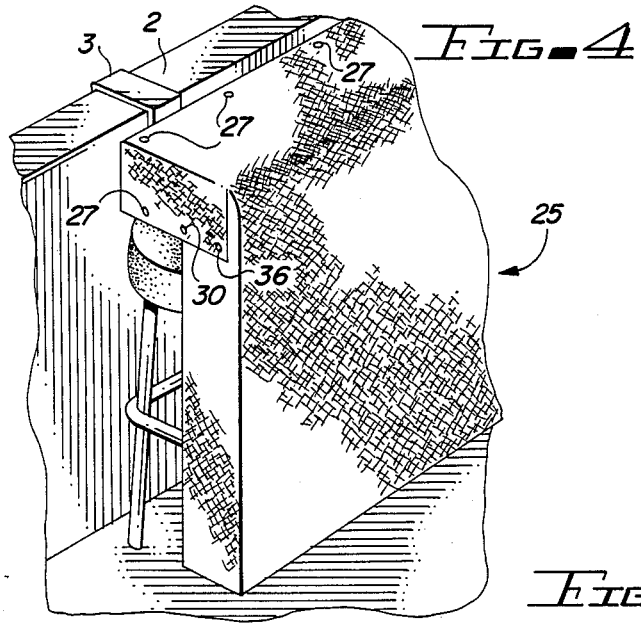
FIG. 4 is a partial view illustrating an optional cover which may be used in conjunction with my balcony accessory.
Figure 5:
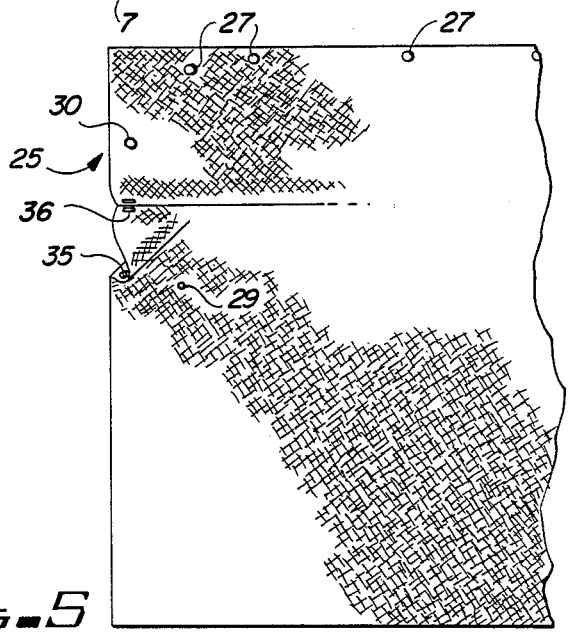
FIG. 5 is a partial view of one end of an accessory cover illustrating one exemplary configuration thereof.

The balcony accessory, as described above, is sufficiently lightweight and easy to handle as to be readily removable after each use for convenient storage in a protected region of the balcony or inside. However, as shown in FIG. 4, a cover 25, which is removably affixed to the balcony accessory when it is in its operative position on the balcony rail 2, may be provided in order to achieve a certain degree of weather protection if the accessory is left suspended from the balcony rail. In order to insure that the cover 25 remains securely in place, sturdy affixing means are preferred. As shown in FIG. 3, a series of male snap fasteners halves 26 are distributed along the upper edge of the inner wall 5, and a single snap fastener is provided (see FIG. 1) on the outer face of each end wall 6. Correspondingly, a series of female snap fastener halves 27 (FIGS. 4 and 5) are distributed along one edge of the cover 25 and are positioned for mating engagement with the male snap fastener halves 26 shown in FIGS. 1 and 3.

Preferably, the left and right ends of the cover 25 fold inwardly to provide more complete weather protection. This may be achieved by simply so fitting the cover 25 during its fabrication process or by providing, as may be seen from FIGS. 4 and 5, a fold in the region 28 of the cover 25 and appropriately positioning male 29, 35 and female 30, 36 snap fastener halves in the cover 25 to achieve the result shown in FIG. 4 at the left end of the cover 25. It will be noted that the male snap fastener half 35 and the female snap fastener half 36 each pass through two layers of material "pinched" together to achieve the desired "lay" of the cover. The female fastener 36 engages the male fastener 29, and the female fastener 30 engages the male fastener 35.

Those skilled in the art will appreciate that the distribution of the snap fasteners need only be appropriate to accomplish the desired results and that many position variations achieve the desired function. Other fixing means, such as hook and loop fasteners, are also contemplated for the cover 25.

While the principles of the invention have now been made clear in an illustrative embodiment, there will be immediately obvious to those skilled in the art many modifications of structure, arrangements, proportions, elements, materials, and components used in the practice of the invention which are particularly adapted for specific environment and use requirements without departing from those principles.

I claim:

1. A balcony accessory adapted for suspension from a balcony rail or the like, said accessory comprising:

A. an elongated, rectangular bottom piece having first and second opposed long edges, first and second opposed short edges, and upper and lower faces;

B. a pair of suspension brackets, each of said brackets being affixed to said lower face of said bottom piece and being positioned near a short edge thereof, each of said brackets comprising:

i. a downwardly opening U-channel for engaging a balcony rail, said U-channel including parallel first and second legs and a horizontal top connecting said legs; and ii. a supporting section extending beneath said bottom piece to horizontally support said bottom piece when said bracket is coupled to a balcony rail or the like over which said U-channel section has been emplaced;

C. an elongated inner wall fixed to and extending perpendicularly, with respect to to said upper face of said bottom piece, from said first long edge of said bottom piece;

D. an elongated rectangular resilient pad having first and second opposed long edges and first and second opposed short edges, said pad being fixed to and extending along said upper face of said bottom piece, said first long edge of said pad terminating proximate said second long edge of said bottom piece, said second long edge of said pad terminating intermediate the width of said bottom piece; and F. first and second end walls, each of said end walls respectively being fixed to and and extending perpendicularly, with respect to said upper face of said upper face of said bottom piece, from a short edge of said bottom piece and reaching to said inner wall;

whereby said inner wall, said end walls, said second long edge of said pad, and a thus-bounded portion of said upper face of said bottom piece define a tray-like storage area.

2. The balcony accessory of claim 1 which further includes a removable cover and affixing means for detachably securing said cover to said inner wall.

3. The balcony accessory of claim 2 in which said affixing means comprises a first series of snap fastener halves distributed along an upper edge of said inner wall and a second series of snap fastener halves correspondingly distributed along an edge of said cover, said first and second series being adapted to detachably mate with one another to secure said cover to said inner wall.

4. The balcony accessory of claim 1 in which said bottom piece and said inner wall are fabricated of wood.

5. The balcony accessory of claim 2 in which said bottom piece and said inner wall are fabricated of wood.

6. The balcony accessory of claim 3 in which said bottom piece and said inner wall are fabricated of wood.

* * * * *